US008820261B2

(12) United States Patent
Lambertus

(10) Patent No.: US 8,820,261 B2
(45) Date of Patent: Sep. 2, 2014

(54) METHOD FOR DETECTING ANOMALIES ON A SUBMARINE OBJECT

(75) Inventor: Detlef Lambertus, Osterholz-Scharmbeck (DE)

(73) Assignee: Atlas Elektronik GmbH, Bremen (DE)

( * ) Notice: Subject to any disclaimer, the term of this patent is extended or adjusted under 35 U.S.C. 154(b) by 360 days.

(21) Appl. No.: 13/322,085

(22) PCT Filed: May 25, 2010

(86) PCT No.: PCT/EP2010/057172

§ 371 (c)(1), (2), (4) Date: Jan. 13, 2012

(87) PCT Pub. No.: WO2010/142526

PCT Pub. Date: Dec. 16, 2010

(65) Prior Publication Data

US 2012/0103245 A1 May 3, 2012

(30) Foreign Application Priority Data

Jun. 9, 2009 (DE) ..... 10 2009 024 342

(51) Int. Cl.
*B63G 8/14* (2006.01)

(52) U.S. Cl.
USPC ..... 114/331

(58) Field of Classification Search
USPC ..... 114/312, 313, 322, 328, 329, 330, 331, 114/337; 367/88
See application file for complete search history.

(56) References Cited

U.S. PATENT DOCUMENTS

| | | | | |
|---|---|---|---|---|
| 5,321,667 | A * | 6/1994 | Audi et al. | 367/88 |
| 5,438,552 | A * | 8/1995 | Audi et al. | 367/88 |
| 7,296,464 | B2 * | 11/2007 | Hostetler | 73/170.33 |
| 2004/0083940 | A1 | 5/2004 | Shelton et al. | |
| 2009/0031940 | A1 | 2/2009 | Stone et al. | |
| 2009/0090286 | A1 | 4/2009 | Korolenko et al. | |

FOREIGN PATENT DOCUMENTS

| | | | |
|---|---|---|---|
| DE | 300802 | A7 | 3/1983 |
| DE | 4302455 | A1 | 8/1994 |
| DE | 102005014555 | A1 | 10/2006 |
| DE | 102005062109 | A1 | 9/2008 |
| EP | 1394822 | A2 | 3/2004 |

* cited by examiner

*Primary Examiner* — Daniel V Venne
(74) *Attorney, Agent, or Firm* — Fitch, Even, Tabin & Flannery, LLP

(57) ABSTRACT

A method for detecting anomalies on a submarine object, in particular in the submarine region on a hull of a moored warcraft, which method carries out very reliable sensing of the submarine object by way of an unmanned small submarine vehicle that is equipped with simple sensor equipment, such as an acoustic sensor for measuring distances and a barometric cell for determining depth, and which method obtains a profile of the submarine object by navigating the small submarine vehicle with a constant transversal distance to the submarine object, in which profile an anomaly present on the submarine object becomes is apparent from the profile line.

12 Claims, 2 Drawing Sheets

METHOD FOR DETECTING ANOMALIES ON A SUBMARINE OBJECT

CROSS REFERENCE TO RELATED APPLICATION

This application is the National Stage filing under 35 U.S.C. 371 of International Application No. PCT/EP2010/057172, filed May 25, 2010, and claims priority of German Patent Application No. 10 2009 024 342.9 filed Jun. 9, 2009, the subject matter of which in its entirety, is incorporated herein by reference.

BACKGROUND OF THE INVENTION

The invention relates to a method for detecting anomalies on an underwater object, in particular on the underwater part of a hull of a submerged watercraft, according to the precharacterizing clause of claim 1.

During times of increasing terrorist threat to civilian and military facilities, their permanent protection is becoming increasingly important. Underwater objects in particular, such as foundations of feed installations and wind farms, docks, marine-vessel hulls of marine-vessels and submarines in harbor, are subject to underwater manipulation by divers or remotely controlled underwater vehicles, without protection. For example, limpet mines can be fitted without being noticed, and are remotely fired.

DE 10 2005 014 555 A1 discloses a mine hunting system and a method for mine hunting using a plurality of autonomously acting underwater vehicles, with a first group of these underwater vehicles, which have sensors, being used for mine location, and a second group of these underwater vehicles being used to attack mines that have been located.

US 2009/0090286 A1 discloses an armed, remotely controlled craft with video and sonar sensors.

Furthermore, DE 10 2005 062 109 A1 discloses a method and an apparatus for defense against personnel ingressing underwater with a person first of all being detected and tracked, and with an unmanned underwater vehicle then being deployed for defense against the person detected.

Furthermore, DE 43 02 455 A1 discloses an underwater drone for attacking mines, with this underwater drone having an antenna device which is suitable for metal detection.

Finally, DD 300 802 A7 discloses an underwater body with a fixed arrangement of hydroacoustic transducers for basic distance measurement which can be used universally in three operating modes.

The invention is based on the object of specifying a cost-effective method for detecting or identifying anomalies on underwater objects, for example of foreign bodies illegally fitted there, such as limpet mines, smuggled goods and the like, which is efficient and can be carried out in a largely automated form without having to use personnel underwater.

According to the invention, the object is achieved by the features in claim 1.

The method according to the invention has the advantage that the underwater object can be scanned very reliably by a single sensor fitting, such as an acoustic sensor for lateral distance measurement and a pressure capsule for depth determination, and a profile of the underwater object is attained by navigation of the small underwater vehicle at a constant lateral distance from the underwater object, in the profile line of which profile an anomaly which exists on the underwater object, for example a foreign body which has been stuck on, is clearly evident. This is a result of the fact that, when the anomaly is detected by the acoustic sensor, the small underwater vehicle continues its movement, which is characterized by a constant lateral distance from the underwater object, because of its inertia, while in contrast, however, a profile change appears in the measurement profile of the acoustic sensor which measures the lateral distance, for example a notch or dip in the profile line, which has already decayed again when the movement control system for the small underwater vehicle is caused to react to the change in the lateral distance by the navigation apparatus, as a result of which the small underwater vehicle continues on its course at a predetermined, constant lateral distance from the underwater object, without any change, independently of the brief change in the lateral distance from the underwater object. The identification of the anomaly in the measurement profile line of the acoustic distance sensor can be moved directly, for example via an optical waveguide towed behind the small underwater vehicle, for warning indication in a monitoring center and can be used to initiate a diver operation for inspection and/or removal of the anomaly, without the small underwater vehicle having to interrupt or terminate its inspection movement. This results in a considerable time saving between identification of the anomaly, and its removal.

Expedient embodiments of the method according to the invention, together with advantageous developments and refinements of the invention, are specified in the further claims.

According to one advantageous embodiment of the method, the position of the small underwater vehicle with respect to the underwater object is found at least on identification of an anomaly. This determination of the position of the small underwater vehicle allows the anomaly to be located on an object-related basis easily, and the inspection and/or removal operation to be carried out by divers in a shorter timescale, and efficiently.

According to one advantageous embodiment of the invention, the small underwater vehicle moves at a constant velocity, and the time of travel is measured continuously during movement. When an anomaly is identified, the position of the anomaly is determined from the time of travel measured until then and the velocity of travel of the small underwater vehicle and the submersion depth of the small underwater vehicle. The time measurement is started when the predetermined lateral distance between the small underwater vehicle and the underwater object is measured for the first time. This procedure allows the position of the small underwater vehicle, and therefore the object-related position of the anomaly, to be detected by a simple time measurement.

According to one advantageous embodiment of the invention, a repeated movement away from the underwater object is carried out and, on each movement away, the constant movement depth is changed. This movement away from the underwater object at different submersion depths also allows the depth component of the anomaly to be determined sufficiently accurately for diver operation using a single acoustic sensor with little vertical shaping of the acoustic scanning beam. In this case, the movement depth change of the small underwater vehicle can be carried out immediately at the end of the underwater object by a 180° reversing turn of the small vehicle or after moving completely around the underwater object.

The method according to the invention will be described in more detail in the following text with reference to one exemplary embodiment which is illustrated in the drawing, in which, illustrated schematically:

Figure 1:
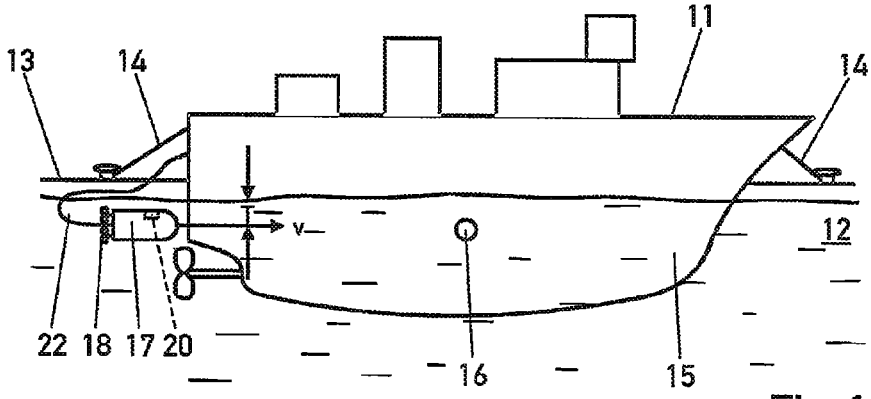
FIG. 1 shows a side view of a surface vessel moored in a dock.
Figure 2:
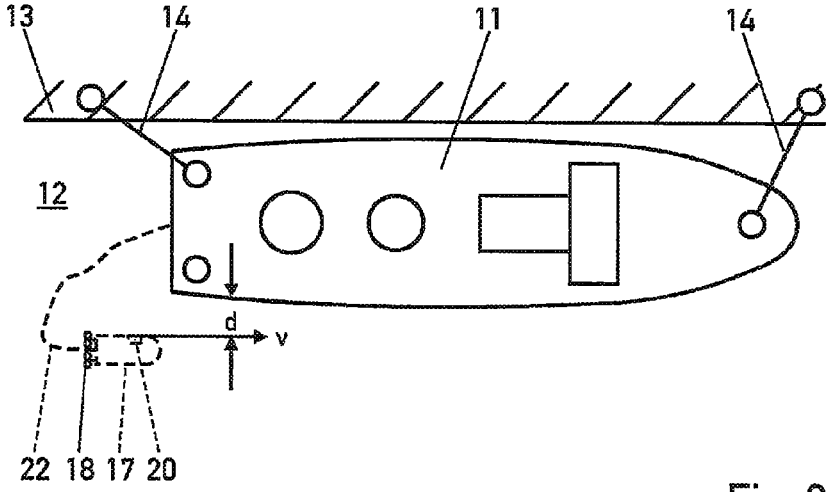
FIG. 2 shows a plan view of the surface vessel in FIG. 1.
Figure 3:
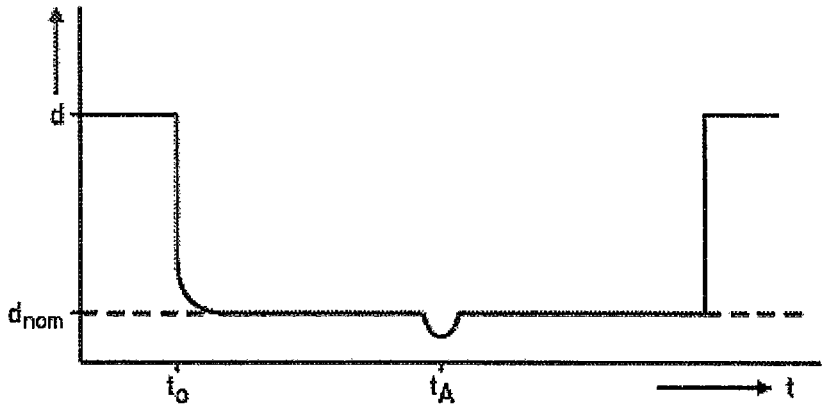
Figure 4:
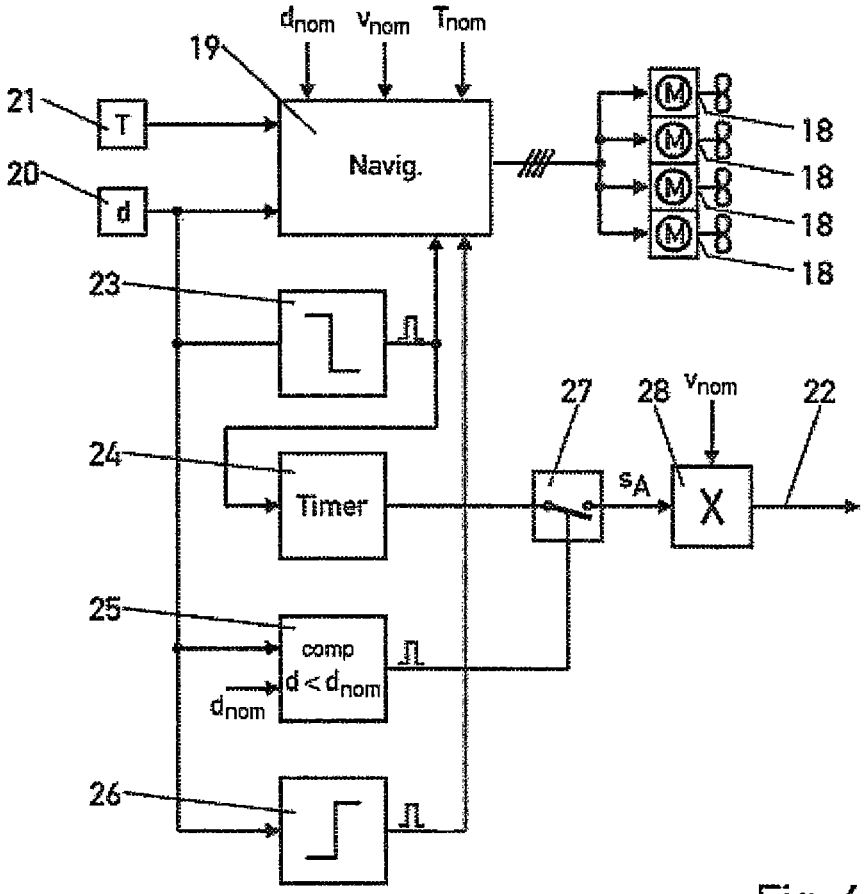

FIG. 3 shows a diagram of the lateral distance between the small underwater vehicle and the hull of the surface vessel as a function of the time of travel when the hull of the surface vessel in FIG. 1 and FIG. 2 is scanned by an acoustic distance sensor during movement of the small underwater vehicle, FIG. 4 shows a block diagram of an apparatus for carrying out the method for detecting or identifying an anomaly on the hull of the surface vessel in FIGS. 1 and 2.

In order to explain the method proposed here for detecting, identifying or discovering anomalies on a stationary underwater object, FIGS. 1 and 2 schematically illustrate a surface vessel 11 which is located in a dock 12 and is moored to a pier 13, that is to say it is held firmly by lines 14.

An anomaly 16 which, for example, may be a limpet mine or a container filled with smuggled goods is illustrated in the underwater area on the hull 15 of the surface vessel 11.

An unmanned small underwater vehicle 17 is used in order to detect an anomaly 16 such as this on the otherwise smooth hull 15 of the surface vessel 11. Such unmanned, self-powered small underwater vehicles are known in many forms with different sensor and measurement apparatus fits. The small underwater vehicle 17 used here has, for example, four propeller drives 18, which are operated separately by a navigation apparatus 19 (FIG. 4) in order to control or navigate the small underwater vehicle 17. Depending on the rotation speed of the individual propeller drives 18, of which in each case two are arranged vertically one above the other and two horizontally alongside one another, the small underwater vehicle 17 can move straight ahead or can be steered to the right or left, and upward or downward. At least one acoustic distance sensor 20 for measurement of a lateral distance which extends horizontally with respect to the craft axis and a depth sensor 21 for determining the submersion depth of the small underwater vehicle 17 are provided as sensors in the small underwater vehicle 17 used here. By way of example, an acoustic distance sensor 20 such as this may be a simple echo sounder which emits sound pulses and receives the echoes resulting from reflection of the sound pulses, measuring the time between transmission and echo reception. The distance to the object causing the reflection of the sound pulses is calculated from the measured time, taking account of the speed of sound. By way of example, the depth sensor 21 is a simple pressure capsule. The output signals from the sensors 20, 21 are supplied to the navigation apparatus 19.

The small underwater vehicle vehicle 17 is deployed into the water from the surface vessel 11 or from the pier 13, for example—as is illustrated in FIGS. 1 and 2—behind the stern of the surface vessel 11, and moves along the hull 15 of the surface vessel 11. During the movement of the small underwater vehicle 17, the acoustic distance sensor 20 continuously measures the horizontal lateral distance between the small underwater vehicle 17 and the hull 15. In this case, the small underwater vehicle 17 is controlled by the navigation apparatus 19 such that it maintains a predetermined lateral distance from the hull 15, at a constant depth. For this purpose, on the one hand, the movement depth and the lateral distance are predetermined as nominal values $T_{nom}$ and $d_{nom}$ of the navigation apparatus 19 (FIG. 4), and on the other hand the measured values are supplied from the distance sensor 20 and the depth sensor 21 as actual values d and T. An appropriate control loop in the navigation apparatus 19 generates control commands as a function thereof, for the four propeller drives 18, which keep the small underwater vehicle 17 on the course that has been mentioned.

The actual lateral distance d which is measured continuously by the distance sensor 20 during the movement of the small underwater vehicle 17 is furthermore compared continuously with the predetermined nominal lateral distance $d_{nom}$ and, if the actual lateral distance d falls significantly below the nominal lateral distance $d_{nom}$, the presence of an anomaly is identified. The small underwater vehicle 17 is preferably connected via a connecting line 22 (FIG. 1) to a mission monitoring center on board the surface vessel 11 and, when an anomaly is detected, an alarm can be triggered via the connecting line 22. In this case, at the moment when the anomaly is detected, the instantaneous position of the small underwater vehicle 17 relative to the hull 15 of the surface vessel 11 is also determined, and is signaled via the connecting line 22 to the mission monitoring center. The position is determined in a simple manner by the small underwater vehicle 17 moving at a constant velocity, which is predetermined as the nominal velocity value $v_{nom}$, for the navigation apparatus 19, and in that the time of travel t is measured from a starting point. The time of travel $t_A$ measured at the time when the anomaly 16 is identified results in the distance $s_A$ traveled at the predetermined submersion depth $T_{nom}$, and the position $P_A(S_A; T_A)$ of the small underwater vehicle 17 is thus found. If the time $t_o$ at which the distance sensor 20 measures a lateral distance d which corresponds to the predetermined nominal lateral distance $d_{nom}$ for the first time after the start of operation of the small underwater vehicle 17 is chosen as the starting time for the time measurement, then the output position $P_A(S_A; T_A)$ of the small underwater vehicle is at the same time the position of the anomaly 16 on the hull 15 of the surface vessel 11.

By way of example, FIG. 4 shows a block diagram of an apparatus which is installed in the small underwater vehicle 17, and by means of which the proposed method for detecting or discovering the anomaly 16 is carried out. In addition to the navigation apparatus 19 which has already been mentioned and the sensors 20, 21 which have already been mentioned, the apparatus also has a first flank detector 23, a timer 24, a comparator 25, a second flank detector 26, a gate circuit 27 and a multiplier 28. The output of the acoustic distance sensor 20 is connected both to the navigation apparatus 19 and to the inputs of the flank detectors 23, 26 and of the comparator 25. Via a second input, the comparator 25 is supplied with the predetermined lateral distance $d_{nom}$ between the small underwater vehicle 17 and the hull 15 of the surface vessel 11. The gate circuit 27 can be operated via the output of the comparator 25, and connects the output of the timer 24 and the input of the multiplier 28, to which the nominal velocity $v_{nom}$ of the small underwater vehicle 17 is supplied as a multiplier. The outputs of the two flank detectors 23, 26 are connected to the navigation apparatus 19.

In order to illustrate the proposed method, FIG. 3 shows a diagram in which the lateral distance d measured by the acoustic distance sensor 20 during the movement of the small underwater vehicle 17 is illustrated as a function of the time of travel t. The small underwater vehicle 17, which is deployed behind the stern of the surface vessel 11, starts to move, and, at the time $t_0$, arrives at a constant velocity and at the submersion depth $T_{nom}$ at the stern end of the hull 15. During this movement, the acoustic distance sensor 20 carries out measurements against the pier wall, and therefore measures the lateral distance d from the pier wall, which is considerably greater than the nominal value $d_{nom}$ predetermined for the navigation apparatus 19. When the small underwater vehicle 17 reaches the hull 15 of the submarine 11, then a significant certain measured-value change occurs at the output of the acoustic distance sensor 20, since the lateral distance d which is now measured by the distance sensor 20 against the hull 15 is very much less than the lateral distance previously measured against the pier wall. This negative certain measured-value change leads to a control pulse at the output of the first flank detector 23, which control pulse on the one hand switches on the distance control loop of the navigation apparatus 19, and on the other hand starts the timer 24. The small underwater vehicle 17 is now controlled on a course on which the small underwater vehicle 17 maintains a constant predetermined lateral distance $d_{nom}$ from the hull 15.

At the time $t_A$, the small underwater vehicle 17 arrives at the anomaly 16 on the hull 15, and the output signal from the acoustic distance sensor 20 falls briefly below the nominal value $d_{nom}$. A pulse occurs at the output of the comparator 25, which continuously compares the actual value, which is output from the distance sensor 20, of the lateral distance d from the hull 15 with the predetermined nominal value of the lateral distance $d_{nom}$, which pulse causes the gate circuit 27 to briefly close. In consequence, the time of travel $t_A$ measured at that time by the timer 24 is passed to the multiplier 28. In the multiplier 28, the time of travel $t_A$ detected at that time is multiplied by the predetermined nominal velocity $v_{nom}$ of the small underwater vehicle 17. The distance $s_A$ of movement obtained from this which, together with the predetermined submersion depth $T_{nom}$ of the small underwater vehicle 17, defines the position of the small underwater vehicle 17 at the moment when the anomaly 16 is detected can be transmitted via the connecting line 22 to the mission monitoring center on board the surface vessel 11, where it is integrated in an alarm indication. On the basis of the alarm indication, the monitoring center can start a guide operation for inspection and removal of the anomaly 16, with the position of the small underwater vehicle 17 determined from the signaled distance $s_A$ of movement and the signaled submersion depth $T_{nom}$ indicating the position $P_A$ of the anomaly 16, which forms the preset target for the diver operation.

Independently of this, the small underwater vehicle 17 continues its movement at a constant lateral distance $d_{nom}$ from the hull 15 of the surface vessel 11. When the small underwater vehicle 17 has reached the end of the hull 15 and moves beyond this, then the acoustic distance sensor 20 once again measures the lateral distance from the pier wall, which is considerably greater than the lateral distance from the hull 15. A significant certain measured-value change to higher measured values occurs at the output of the distance sensor 20. The positive flank of the certain measured-value change is detected in the second flank detector 26. The latter produces a control pulse, which is passed to the navigation apparatus 19, where it initiates a movement of the small underwater vehicle 17, for example a turning maneuver to a different submersion depth.

The described process of the small underwater vehicle 17 moving away from the hull 15 is carried out repeatedly at a different submersion depth of the small underwater vehicle 17, in such a way that the entire hull 15 is also scanned completely by the acoustic distance sensor 20 in the vertical dimension. After leaving the hull area, it is sensible for the small underwater vehicle to carry out a 180° turn, and to move away from the hull 15 at the next submersion depth, in the opposite direction to its previous movement path. In this case, the small underwater vehicle 17 must be equipped with a second acoustic distance sensor, whose measurement direction is rotated through 180° with respect to that of the first acoustic distance sensor 20.

All of the features mentioned in the above description of the figures, in the claims and in the introductory part of the description can be used both individually and in any desired combination with one another. The invention is therefore not restricted to the combinations of features described and claimed. In fact, all combinations of features should be considered as having been disclosed.

The invention claimed is:

1. A method for detecting anomalies (16) on an underwater object, said method comprising:

(i) moving an unmanned underwater vehicle (17), while the unmanned underwater vehicle (17) is submerged at a constant depth ($T_{nom}$), along the underwater object, the unmanned underwater vehicle (17) having a navigation apparatus (19) and an acoustic sensor, wherein the acoustic sensor measures the lateral distance (d) between unmanned underwater vehicle (17) and the underwater object as the unmanned underwater vehicle (17) moves along the underwater object, and the navigation apparatus (19) controls the unmanned underwater vehicle (17) such that the unmanned underwater vehicle (17) maintains a constant predetermined lateral distance ($d_{nom}$) from the underwater object, (ii) comparing the measured lateral distance (d) as the unmanned underwater vehicle (17) moves along the underwater object with the predetermined lateral distance ($d_{nom}$), and (iii) identifying an anomaly (16) on the underwater object based on a discrepancy between the measured lateral distance (d) and the predetermined lateral distance ($d_{nom}$), wherein the underwater object comprises a hull (15) of a watercraft.

2. The method as claimed in claim 1, wherein the method further comprises (iv) moving the unmanned underwater vehicle (17) away from the underwater object, and (v) changing the depth of the unmanned underwater vehicle (17) to a different constant movement depth ($T_{nom}$).

3. The method as claimed in claim 2, wherein the method further comprises (vi) determining the position of the unmanned underwater vehicle (17) with respect to the underwater object at least on identification of an anomaly.

4. The method as claimed in claim 3, wherein the method further comprises (vii) continuously measuring the time of travel (t) as the unmanned underwater vehicle (17) moves at a constant velocity ($v_{nom}$) along the underwater object and obtaining an elapsed time of travel ($t_A$) from such measurement, and (viii) when an anomaly is identified, determining the horizontal component of the position of the anomaly (16) on hull (15) from the elapsed time of travel ($t_A$) and the velocity of travel ($v_{nom}$) of the unmanned underwater vehicle (17).

5. The method as claimed in claim 1, wherein the method further comprises determining the position of the unmanned underwater vehicle (17) with respect to the underwater object at least when identifying an anomaly.

6. The method as claimed in claim 5, wherein the method further comprises in (i) moving the unmanned underwater vehicle (17) at a constant velocity ($v_{nom}$) along the underwater object, continuously measuring the time of travel (t) during such movement in (i) and obtaining an elapsed time of travel ($t_A$) from such measurement, and, when an anomaly is identified, determining a horizontal component of the position of the anomaly (16) from the time of travel ($t_A$) and the velocity of travel ($v_{nom}$) of the unmanned underwater vehicle (17).

7. The method as claimed in claim 1, wherein the method further comprises (iv) changing the depth of the underwater vehicle (17) to another constant depth ($T_{nom}$); and repeating at least steps (i) and (ii).

8. The method as claimed in claim 2, wherein after (v), the method further comprises repeating at least steps (i) and (ii).

9. The method as claimed in claim 1, wherein the method further comprises continuously measuring the time of travel (t) as the unmanned underwater vehicle (17) moves at a constant velocity ($v_{nom}$) along the underwater object and obtaining an elapsed time of travel ($t_A$) from such measurement, and when an anomaly is identified, determining the horizontal component of the position of the anomaly (16) on hull (15) from the elapsed time of travel ($t_A$) and the velocity of travel ($v_{nom}$) of the unmanned underwater vehicle (17).

10. The method as claimed in claim 1, wherein the watercraft is a surface vessel.

11. The method as claimed in claim 2, wherein the watercraft is submerged.

12. The method as claimed in claim 1, wherein the watercraft is a submarine.

* * * * *